US010942466B2

(12) United States Patent
Tominaga et al.

(10) Patent No.: US 10,942,466 B2
(45) Date of Patent: Mar. 9, 2021

(54) TONER WITH AN EXTERNAL ADDITIVE OF AN ORGANOSILICON POLYMER PARTICLE HAVING A HYDROXYL GROUP

(71) Applicant: CANON KABUSHIKI KAISHA, Tokyo (JP)

(72) Inventors: Tsuneyoshi Tominaga, Suntou-gun (JP); Masatake Tanaka, Yokohama (JP); Taiji Katsura, Suntou-gun (JP); Masamichi Sato, Mishima (JP); Shohei Kototani, Suntou-gun (JP); Kentaro Yamawaki, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/728,050

(22) Filed: Dec. 27, 2019

(65) Prior Publication Data

US 2020/0209773 A1 Jul. 2, 2020

(30) Foreign Application Priority Data

Dec. 28, 2018 (JP) ..... JP2018-246983

(51) Int. Cl.
*G03G 9/08* (2006.01)
*G03G 9/097* (2006.01)
*G03G 9/087* (2006.01)

(52) U.S. Cl.
CPC ..... *G03G 9/09775* (2013.01); *G03G 9/0819* (2013.01); *G03G 9/08728* (2013.01); *G03G 9/09708* (2013.01)

(58) Field of Classification Search
CPC ..... G03G 9/09775; G03G 9/0819; G03G 9/08728; G03G 9/09708
USPC ..... 430/108.3
See application file for complete search history.

(56) References Cited

U.S. PATENT DOCUMENTS

| | | | |
|---|---|---|---|
| 7,833,685 | B2 | 11/2010 | Tanaka et al. |
| 8,372,573 | B2 | 2/2013 | Ayaki et al. |
| 8,377,616 | B2 | 2/2013 | Tani et al. |
| 8,383,313 | B2 | 2/2013 | Ayaki et al. |
| 8,551,680 | B2 | 10/2013 | Ayaki et al. |
| 8,628,899 | B2 | 1/2014 | Kawamura et al. |
| 8,815,484 | B2 | 8/2014 | Tanaka et al. |
| 9,158,216 | B2 | 10/2015 | Shimano et al. |
| 9,341,967 | B2 | 5/2016 | Tsujino et al. |
| 9,366,981 | B2 | 6/2016 | Yamawaki et al. |
| 9,377,705 | B2 | 6/2016 | Shimano et al. |
| 9,383,668 | B2 | 7/2016 | Noji et al. |
| 9,423,708 | B2 | 8/2016 | Tominaga et al. |
| 9,500,972 | B2 | 11/2016 | Tanaka et al. |
| 9,575,424 | B2 | 2/2017 | Nakagawa et al. |
| 9,599,919 | B2 | 3/2017 | Isono et al. |
| 9,632,441 | B2 | 4/2017 | Abe et al. |
| 9,658,549 | B2 | 5/2017 | Tanaka et al. |
| 9,720,340 | B2 | 8/2017 | Tominaga et al. |
| 9,733,583 | B2 | 8/2017 | Kuroki et al. |
| 9,733,584 | B2 | 8/2017 | Masumoto et al. |
| 9,785,071 | B2 | 10/2017 | Shimano et al. |
| 9,785,077 | B2 | 10/2017 | Abe et al. |
| 9,829,816 | B2 | 11/2017 | Tanaka et al. |
| 9,829,820 | B2 | 11/2017 | Masumoto et al. |
| 9,835,964 | B2 | 12/2017 | Yoshida et al. |
| 9,897,932 | B2 | 2/2018 | Hotta et al. |
| 9,904,193 | B2 | 2/2018 | Nakagawa et al. |
| 9,921,501 | B2 | 3/2018 | Mochizuki et al. |
| 9,958,801 | B2 | 5/2018 | Tanaka et al. |
| 10,054,866 | B2 | 8/2018 | Tanaka et al. |
| 10,114,303 | B2 | 10/2018 | Katsura et al. |
| 10,429,757 | B2 | 10/2019 | Yoshida et al. |
| 10,503,090 | B2 | 12/2019 | Tominaga et al. |
| 10,545,422 | B2 | 1/2020 | Yamawaki et al. |
| 2004/0058258 | A1 | 3/2004 | Yoshino et al. |
| 2004/0137356 | A1 | 7/2004 | Tomita et al. |
| 2008/0226998 | A1 | 9/2008 | Ishii et al. |
| 2009/0117477 | A1 | 5/2009 | Magome et al. |
| 2009/0155706 | A1 | 6/2009 | Shu et al. |

(Continued)

FOREIGN PATENT DOCUMENTS

| | | |
|---|---|---|
| EP | 0 430 076 | 6/1991 |
| EP | 2 669 740 | 12/2013 |

(Continued)

OTHER PUBLICATIONS

U.S. Appl. No. 16/670,352, Kentaro Yamawaki, filed Oct. 31, 2019.
U.S. Appl. No. 16/728,060, Kentaro Yamawaki, filed Dec. 27, 2019.
U.S. Appl. No. 16/728,082, Yasuhiro Hashimoto, filed Dec. 27, 2019.
U.S. Appl. No. 16/728,101, Taiji Katsura, filed Dec. 27, 2019.
U.S. Appl. No. 16/728,115, Shotaru Nomura, filed Dec. 27, 2019.
U.S. Appl. No. 16/728,122, Masamichi Sato, filed Dec. 27, 2019.
U.S. Appl. No. 16/728,151, Masatake Tanaka, filed Dec. 27, 2019.
U.S. Appl. No. 16/728,157, Shohei Kototani, filed Dec. 27, 2019.
U.S. Appl. No. 16/728,171, Takaaki Furui, filed Dec. 27, 2019.
U.S. Appl. No. 16/728,179, Koji Nishikawa, filed Dec. 27, 2019.

*Primary Examiner* — Mark A Chapman
(74) *Attorney, Agent, or Firm* — Venable LLP

(57) ABSTRACT

A toner including a toner particle containing a binder resin and an external additive, wherein the toner particle contains a polyvalent metal compound, the polyvalent metal compound is at least one selected from the group consisting of aluminum compounds, iron compounds and magnesium compounds, a content of a metal element derived from the polyvalent metal compound in the toner particle is from 0.080 to 20.000 μmol/g, the external additive contains an organosilicon polymer particle having a hydroxyl group, a ratio of a number-average particle diameter of the organosilicon polymer particle to a number-average particle diameter of the toner particle is from 0.0160 to 0.0650, and a content of the organosilicon polymer particle is at least 0.10 mass parts per 100.00 mass parts of the toner particle.

9 Claims, No Drawings

(56) References Cited

U.S. PATENT DOCUMENTS

| | | | | |
|---|---|---|---|---|
| 2010/0035171 | A1 | 2/2010 | Watanabe et al. | |
| 2010/0248110 | A1 | 9/2010 | Taguchi et al. | |
| 2014/0220488 | A1 | 8/2014 | Hosoya et al. | |
| 2014/0356779 | A1 | 12/2014 | Hasegawa et al. | |
| 2015/0248072 | A1 | 9/2015 | Katsuta et al. | |
| 2016/0187799 | A1 | 6/2016 | Hiroshi et al. | |
| 2016/0299446 | A1 | 10/2016 | Kuroki et al. | |
| 2017/0219947 | A1 | 8/2017 | Omori et al. | |
| 2017/0329246 | A1* | 11/2017 | Yamawaki ..... | G03G 9/0821 |
| 2018/0329323 | A1 | 11/2018 | Kimura et al. | |
| 2018/0329324 | A1 | 11/2018 | Kamikura et al. | |
| 2018/0329327 | A1 | 11/2018 | Yamawaki et al. | |
| 2018/0329329 | A1 | 11/2018 | Nakamura et al. | |
| 2019/0332024 | A1 | 10/2019 | Umeda et al. | |
| 2020/0026208 | A1 | 1/2020 | Terui et al. | |
| 2020/0026209 | A1 | 1/2020 | Yagi et al. | |
| 2020/0124998 | A1 | 4/2020 | Kototani et al. | |
| 2020/0124999 | A1 | 4/2020 | Tanaka et al. | |

FOREIGN PATENT DOCUMENTS

| | | |
|---|---|---|
| EP | 2 818 932 | 12/2014 |
| EP | 2 853 945 | 4/2015 |
| EP | 2 860 585 | 4/2015 |
| EP | 3 095 805 | 11/2016 |
| EP | 3 480 661 | 5/2019 |
| JP | 2017-122873 | 7/2017 |
| JP | 2018-072389 | 5/2018 |
| WO | 2018/003749 | 1/2018 |

* cited by examiner

TONER WITH AN EXTERNAL ADDITIVE OF AN ORGANOSILICON POLYMER PARTICLE HAVING A HYDROXYL GROUP

BACKGROUND OF THE INVENTION

Field of the Invention

The present invention relates to a toner for use in developing electrostatic images in image-forming methods such as electrophotography and electrostatic printing.

Description of the Related Art

The requirements for copiers and printers have become more diverse in the recent years, and higher speeds, longer operating lives and higher image quality and the like are required in a variety of environments. Methods have been adopted for improving the durability, charging performance and flowability of the toner by externally adding silica particles to the toner particle. As one example, external addition of silsesquioxane particles has been studied as a means of improving such toner performance.

In Japanese Patent Application Publication No. 2018-72389, charging performance is stabilized by externally adding to the toner particle a polysiloxane particle made up of multiple units.

In Japanese Patent Application Publication No. 2017-122873, detachment of a silsesquioxane particle is prevented by keeping the particle size of the silsesquioxane particle within a specific range, and by including a crystalline resin and an amorphous resin in the toner binder resin.

SUMMARY OF THE INVENTION

However, it has been found that with the toner of Japanese Patent Application Publication No. 2018-72389, the polysiloxane particle detaches during long-term use, raising the risk of fogging.

In Japanese Patent Application Publication No. 2017-122873, moreover, it has been found that excessive embedding of the silsesquioxane particle and toner cracking occur during long-term use in high-temperature, high-humidity environments, and there is a risk of contamination of the developing members such as the toner carrying member and the developing blade.

The present invention provides a toner whereby fogging and contamination of the members can be prevented even during long-term use in high-temperature, high-humidity environments.

The present invention relates to a toner including:

a toner particle containing a binder resin, and an external additive, wherein the toner particle contains a polyvalent metal compound, the polyvalent metal compound is at least one selected from the group consisting of aluminum compounds, iron compounds and magnesium compounds, a content of a metal element derived from the polyvalent metal compound in the toner particle is from 0.080 μmol/g to 20.000 μmol/g, the external additive contains an organosilicon polymer particle having a hydroxyl group, a ratio of a number-average particle diameter of the organosilicon polymer particle to a number-average particle diameter of the toner particle is from 0.0160 to 0.0650, and a content of the organosilicon polymer particle is at least 0.10 mass parts per 100.00 mass parts of the toner particle.

With the present invention, it is possible to obtain a toner whereby fogging and contamination of the members are prevented even during long-term use in high-temperature, high-humidity environments.

Further features of the present invention will become apparent from the following description of exemplary embodiments.

DESCRIPTION OF THE EMBODIMENTS

Unless otherwise specified, descriptions of numerical ranges such as "from XX to YY" or "XX to YY" in the present invention include the numbers at the upper and lower limits of the range.

The inventors discovered as the result of exhaustive research that the above problems could be solved with a toner including:

a toner particle containing a binder resin, and an external additive, wherein the toner particle contains a polyvalent metal compound, the polyvalent metal compound is at least one selected from the group consisting of aluminum compounds, iron compounds and magnesium compounds, a content of a metal element derived from the polyvalent metal compound in the toner particle is from 0.080 μmol/g to 20.000 μmol/g, the external additive contains an organosilicon polymer particle having a hydroxyl group, a ratio of a number-average particle diameter of the organosilicon polymer particle to a number-average particle diameter of the toner particle is 0.0160 to 0.0650, and a content of the organosilicon polymer particle is at least 0.10 mass parts per 100.00 mass parts of the toner particle.

The inventors consider that the effects of the present invention are obtained for the following reasons. In the present invention, the organosilicon polymer particle has a hydroxyl group, and the toner particle contains a specific metal. Consequently, it is thought that the hydroxyl group in the organosilicon polymer particle and the metal element are electrostatically attracted to one another, thereby improving the fixing properties of the organosilicon polymer particle.

It is also thought that if the number-average particle diameters of the toner particle and organosilicon polymer particle are controlled, contact between the developing members and parts of the toner particle surface lacking fixed organosilicon polymer particles can be prevented, and contamination of the developing members can be prevented.

The toner particle is explained below.

The toner particle contains a polyvalent metal compound, and the polyvalent metal compound is at least one selected from the group consisting of aluminum compounds, iron compounds and magnesium compounds.

Another feature is that the content of a metal element derived from the polyvalent metal compound in the toner particle is from 0.080 μmol/g to 20.000 μmol/g, or preferably from 0.080 μmol/g to 14.000 μmol/g.

Aluminum, iron and magnesium have relatively strong ionization tendencies, and because they ionize easily, they can be electrostatically attracted to the hydroxyl groups of the organosilicon polymer particle when the content of the metal element is at least 0.080 μmol/g. If this metal element content is too high, however, fogging occurs due to toner charge leakage in high-temperature, high-humidity environments, so the metal element content in the polyvalent metal compound in the toner particle must be not more than 20.000 μmol/g.

When two or more polyvalent metal elements are included, the total content of these metal elements is within the above range.

The method for including the polyvalent metal compound in the toner particle is not particularly limited. If the toner particle is manufactured by a pulverization method for example, the polyvalent metal compound may be included in advance in the raw material resin. It may also be included in the toner particle by adding it during melt kneading of the raw materials.

When the toner particle is manufactured by a wet method such as a polymerization method, the compound may be included in the raw materials or added via an aqueous medium in the manufacturing process. From the standpoint of uniformity, it is desirable to include the compound in the toner particle by adding it in an ionized state in an aqueous medium in a wet manufacturing method.

In emulsion aggregation methods in particular, the polyvalent metal compound can be included in the toner particle by using it as a flocculant. In this case, the metal ions derived from the polyvalent metal compound exist relatively uniformly in the binder resin. Such metal ions are present not only in the interior of the toner particle but also near the toner particle surface, which is desirable because it allows the organosilicon polymer particle to be fixed strongly. The content of the metal element can be measured by the methods described below.

When the polyvalent metal compound is mixed during manufacturing, it can be in the form of a halide, hydroxide, oxide, sulfide, carbonate, sulfate, hexafluorosilylate, acetate, thiosulfate, phosphate, chlorate, nitrate or the like. As discussed above, these are preferably included in the toner particle by ionizing them in an aqueous medium and adding them in an ionized state.

An aqueous medium is a medium comprising at least 50 mass % water and not more than 50 mass % of a water-soluble organic solvent. Examples of water-soluble organic solvents include methanol, ethanol, isopropanol, butanol, acetone, methyl ethyl ketone and tetrahydrofuran.

When the polyvalent metal compound contains aluminum, the aluminum content of the toner particle is preferably from 0.080 μmol/g to 0.400 μmol/g, or more preferably from 0.100 μmol/g to 0.320 μmol/g.

When the polyvalent metal compound contains iron, the iron content of the toner particle is preferably from 0.250 μmol/g to 1.250 μmol/g, or more preferably from 0.375 μmol/g to 1.000 μmol/g.

When the polyvalent metal compound contains magnesium, the magnesium content of the toner particle is preferably from 2.000 μmol/g to 20.000 μmol/g, or more preferably from 4.000 μmol/g to 14.000 μmol/g.

The contents of these polyvalent metal elements can be controlled by controlling the added amounts of the polyvalent metal compounds when preparing the toner particle. When these polyvalent metal compounds are externally added, they can be removed by washing and measured.

The reason why the preferred content range of the polyvalent metal element differs depending on the substance is believed to be related to the valence of the metal. That is, when the valence is high, a smaller amount of the metal can coordinate with the hydroxyl groups of the organosilicon polymer particle, so the trivalent aluminum is used in a small amount, the bivalent magnesium in a larger amount, and the iron (which may have a mixed valence) in an intermediate amount. Preferably the polyvalent metal compound contains an aluminum compound, and more preferably the polyvalent metal compound is an aluminum compound.

The toner particle preferably contains amorphous vinyl resin with an acid value of from 1.0 mg KOH/g to 40.0 mg KOH/g at the surface of the toner particle. The acid value is more preferably from 3.0 mg KOH/g to 20.0 mg KOH/g. Deterioration during continuous use is prevented if such a resin is present on the toner particle surface. This is thought to be due to partial metal-crosslinking that occurs due to the presence of acid groups and polyvalent metal on the surface, resulting in improved durability.

The number-average particle diameter of the toner particle is preferably from 4.0 μm to 10.0 μm, or more preferably from 5.0 μm to 9.0 μm.

The external additive used in the present invention is explained below.

The external additive contains an organosilicon polymer particle having a hydroxyl group. The organosilicon polymer having a hydroxyl group is preferably a silsesquioxane particle having a hydroxyl group. The organosilicon polymer particle has organic functional groups, and is preferably a particle having a structure represented by $(R^aSiO_{3/2})_n$ (in which $R^a$ is an organic functional group), obtained by hydrolysis and condensation of a trifunctional silane.

That is, the organosilicon polymer particle has a structure of alternately bonded silicon atoms and oxygen atoms, and the organosilicon polymer preferably has a T3 unit structure represented by $R^aSiO_{3/2}$.

Moreover, in $^{29}$Si-NMR measurement of the organosilicon polymer particle, the ratio of the area of a peak derived from silicon having the T3 unit structure relative to the total area of peaks derived from all silicon elements contained in the organosilicon polymer particle is preferably from 0.90 to 1.00, or more preferably from 0.95 to 1.00.

There are no particular limitation on the way in which the organosilicon polymer particle has a hydroxyl group, but a silanol derivative having a silsesquioxane structure in which part of $(R^aSiO_{3/2})_n$ above is $(R^aSi(OH)O_{2/2})$ is preferred.

$R^a$ above is not particularly limited, but examples include $C_{1-6}$ (preferably $C_{1-3}$, or more preferably $C_{1-2}$) hydrocarbon (preferably alkyl) groups and aryl (preferably phenyl) groups.

A silanol derivative having a silsesquioxane structure can be detected in the toner by pyrolysis GC/MS for example. Pyrolysis GC/MS measurement methods are described below.

In pyrolysis GC/MS of the organosilicon polymer particle, the integrated value of peaks derived from the cage-shaped silsesquioxane structure silanol derivative represented by formula (2) below is preferably at least 0.001, or more preferably at least 0.002, or still more preferably at least 0.003 given 1.000 as the integrated value of peaks derived from the cage-shaped silsesquioxane structure represented by formula (1) below. The upper limit is not particularly limited, but is preferably not more than 0.100, or more preferably not more than 0.050, or still more preferably mot more than 0.030.

(1)

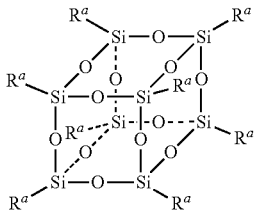

-continued (2)

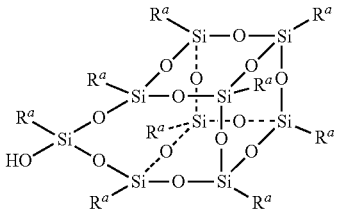

Moreover, in the present invention the ratio (B/A) of the number-average particle diameter (B) of the organosilicon polymer particle to the number-average particle diameter (A) of the toner particle is 0.0160 to 0.0650. That is, because the organosilicon polymer particle is relatively large as an external additive relative to the toner particle, it exerts an adequate spacer effect, and can therefore prevent parts of the toner particle surface lacking fixed organosilicon polymer particles from contacting the developing members.

Contamination of the developing members can also be prevented because embedding of the organosilicon polymer particle in the toner particle surface can be prevented. If the ratio of the number-average particle diameters is less than 0.0160, embedding of the organosilicon polymer particle occurs, the toner carrying member becomes contaminated, and streaks occur on the developing blade.

If the ratio of the number-average particle diameters exceeds 0.0650, the organosilicon polymer particle detaches, and fogging occurs. The ratio is preferably from 0.0200 to 0.0500.

The number-average particle diameter of the organosilicon polymer particle is preferably from 120 nm to 350 nm, or more preferably from 150 nm to 300 nm. If the number-average particle diameter is at least 120 nm, transferability can be further improved. If it is not more than 350 nm, fogging can be further prevented.

The content of the organosilicon polymer particle is preferably at least 0.10 mass parts per 100.00 mass parts of the toner particle. If the content is at least 0.10 mass parts, the effects of the present invention can be realized. If it is less than 0.10 mass parts, contamination of the members occurs, and transferability also declines. The content is preferably from 0.10 mass parts to 5.00 mass parts per 100.00 mass parts of the toner particle.

The content of a metal element derived from the polyvalent metal compound is preferably from 10 μmol to 5000 μmol per 1 g of the organosilicon polymer particle. Within this range, the organosilicon polymer particle is more easily fixed to the toner particle surface. A range from 10 μmol to 1000 μmol per 1 g of the organosilicon polymer particle is more preferred, and from 20 μmol to 400 μmol per 1 g of the organosilicon polymer particle is still more preferred.

The method for manufacturing the silanol derivative having a silsesquioxane structure is not particularly limited, but a method such as the following is preferred.

An organic silicon compound (hereunder called a trifunctional silane) comprising $R^a$ and three reactive groups (halogen atoms, hydroxyl groups, acetoxy groups or alkoxy groups) bound to each silicon atom is added to an aqueous medium.

When hydrolysis and condensation reactions are performed with the trifunctional silane dissolved or dispersed in the aqueous medium, various organosilicon polymer compounds are produced, and a silanol derivative compound having a silsesquioxane structure is obtained as one of these compounds. The amount of silanol derivative structures (amount of hydroxyl groups) can be controlled by controlling hydrolysis and addition polymerization of the trifunctional silane for example, and specifically by controlling the reaction temperatures, reaction times and reaction solvents and the pH, drying temperature and drying time.

An organic silicon compound serving as a precursor of a silanol derivative compound having a silsesquioxane structure is explained below.

The silanol derivative compound having a silsesquioxane structure is preferably a polycondensate of an organic silicon compound having a structure represented by formula (Z) below.

(Z)

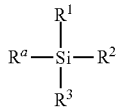

(in formula (Z), $R^a$ represents an organic functional group, and each of $R^1$, $R^2$ and $R^3$ independently represents a halogen atom, hydroxyl group or acetoxy group, or a (preferably $C_{1-3}$) alkoxy group).

$R^a$ is an organic functional group without any particular limitations, but preferred examples include $C_{1-6}$ (preferably $C_{1-3}$, more preferably $C_{1-2}$) hydrocarbon groups (preferably alkyl groups) and aryl (preferably phenyl) groups.

Each of $R^1$, $R^2$ and $R^3$ independently represents a halogen atom, hydroxyl group, acetoxy group or alkoxy group. These are reactive groups that form crosslinked structures by hydrolysis, addition polymerization and condensation. Hydrolysis, addition polymerization and condensation of $R^1$, $R^2$ and $R^3$ can be controlled by means of the reaction temperature, reaction time, reaction solvent and pH.

Examples of formula (Z) include the following:

trifunctional methylsilanes such as p-styryl trimethoxysilane, methyl trimethoxysilane, methyl triethoxysilane, methyl diethoxymethoxysilane, methyl ethoxydimethoxysilane, methyl trichlorosilane, methyl methoxydichlorosilane, methyl ethoxydichlorosilane, methyl dimethoxychlorosilane, methyl methoxyethoxychlorosilane, methyl diethoxychlorosilane, methyl triacetoxysilane, methyl diacetoxymethoxysilane, methyl diacetoxyethoxysilane, methyl acetoxydimethoxysilane, methyl acetoxymethoxyethoxysilane, methyl acetoxydiethoxysilane, methyl trihydroxysilane, methyl methoxydihydroxysilane, methyl ethoxydihydroxysilane, methyl dimethoxyhydroxysilane, methyl ethoxymethoxyhydroxysilane and methyl diethoxyhydroxysilane; trifunctional ethylsilanes such as ethyl trimethoxysilane, ethyl triethoxysilane, ethyl trichlorosilane, ethyl triacetoxysilane and ethyl trihydroxysilane; trifunctional propylsilanes such as propyl trimethoxysilane, propyl triethoxysilane, propyl trichlorosilane, propyl triacetoxysilane and propyl trihydroxysilane; trifunctional butylsilanes such as butyl trimethoxysilane, butyl triethoxysilane, butyl trichlorosilane, butyl triacetoxysilane and butyl trihydroxysilane; trifunctional hexylsilanes such as hexyl trimethoxysilane, hexyl triethoxysilane, hexyl trichlorosilane, hexyl triacetoxysilane and hexyl trihydroxysilane; and trifunctional phenylsilanes such as phenyl trimethoxysilane, phenyl triethoxysilane, phenyl trichlorosilane, phenyl triacetoxysilane and phenyl trihydroxysilane. These organosilicon compounds may be used individually, or two or more kinds may be combined.

The following may also be used in combination with the organosilicon compound having the structure represented by formula (Z): organosilicon compounds having four reactive groups in the molecule (tetrafunctional silanes), organosilicon compounds having two reactive groups in the molecule (bifunctional silanes), and organosilicon compounds having one reactive group in the molecule (monofunctional silanes). Examples include:

dimethyl diethoxysilane, tetraethoxysilane, hexamethyl disilazane, 3-aminopropyl trimethoxysilane, 3-aminopropyl triethoxysilane, 3-(2-aminoethyl)aminopropyl trimethoxysilane, 3-(2-aminoethyl)aminopropyl triethoxysilane, and trifunctional vinyl silanes such as vinyl triisocyanatosilane, vinyl trimethoxysilane, vinyl triethoxysilane, vinyl diethoxymethoxysilane, vinyl ethoxydimethoxysilane, vinyl ethoxydihydroxysilane, vinyl dimethoxyhydroxysilane, vinyl ethoxymethoxyhydroxysilane and vinyl diethoxyhydroxysilane.

The content of the structure represented by formula (Z) in the monomers forming the organosilicon polymer is preferably at least 50 mol %, or more preferably at least 60 mol %.

Toner Particle Manufacturing Method

A known method such as a kneading pulverization method or wet manufacturing method may be used as the method for manufacturing the toner particle. A wet method is preferred for obtaining a uniform particle diameter and controlling the particle shape. Examples of wet manufacturing methods include suspension polymerization methods, dissolution suspension methods, emulsion aggregation methods and the like, and an emulsion aggregation method is preferred. This is because the polyvalent metal element is easier to ionize in an aqueous medium, and also because the polyvalent metal element is easier to include in the toner particle when the binder resin is aggregated.

In emulsion aggregation methods, a liquid dispersion is first prepared with materials including a fine particle of a binder resin and a fine particle of colorant as necessary. A dispersion stabilizer may also be added to the resulting dispersion of the materials, which is then dispersed and mixed. A flocculant is then added to aggregate the mixture until the desired toner particle size is reached, and the resin particles are also melt adhered together either after or during aggregation. Shape control with heat may also be performed as necessary in this method to form a toner particle.

The fine particle of the binder resin here may be a composite particle formed as a multilayer particle comprising two or more layers composed of different resins. For example, this can be manufactured by an emulsion polymerization method, mini-emulsion polymerization method, phase inversion emulsion method or the like, or by a combination of multiple manufacturing methods.

When the toner particle contains an internal additive, the internal additive may be included in the resin fine particle. A liquid dispersion of an internal additive fine particle consisting only of the internal additive may also be prepared separately, and the internal additive fine particle may then be aggregated together with the resin fine particle. Resin fine particles with different compositions may also be added at different times during aggregation, and aggregated to prepare a toner particle composed of layers with different compositions.

Dispersion Stabilizer

The following may be used as the dispersion stabilizer:

inorganic dispersion stabilizers such as tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica and alumina.

Other examples include organic dispersion stabilizers such as polyvinyl alcohol, gelatin, methyl cellulose, methyl hydroxypropyl cellulose, ethyl cellulose, carboxymethyl cellulose sodium salt, and starch.

A known cationic surfactant, anionic surfactant or nonionic surfactant may be used as the surfactant.

Specific examples of cationic surfactants include dodecyl ammonium bromide, dodecyl trimethylammonium bromide, dodecylpyridinium chloride, dodecylpyridinium bromide, hexadecyltrimethyl ammonium bromide and the like.

Specific examples of nonionic surfactants include dodecylpolyoxyethylene ether, hexadecylpolyoxyethylene ether, nonylphenylpolyoxyethylene ether, lauryl polyoxyethylene ether, sorbitan monooleate polyoxyethylene ether, styrylphenyl polyoxyethylene ether, monodecanoyl sucrose and the like.

Specific examples of anionic surfactants include aliphatic soaps such as sodium stearate and sodium laurate, and sodium lauryl sulfate, sodium dodecylbenzene sulfonate, sodium polyoxyethylene (2) lauryl ether sulfate and the like.

Binder Resin

The binder resin constituting the toner particle is explained below.

Preferred examples of the binder resin include vinyl resins, polyester resins and the like. Examples of vinyl resins, polyester resins and other binder resins include the following resins and polymers:

monopolymers of styrenes and substituted styrenes, such as polystyrene and polyvinyl toluene; styrene copolymers such as styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer and styrene-maleic acid ester copolymer; and polymethyl methacryalte, polybutyl methacrylate, polvinyl acetate, polyethylene, polypropylene, polvinyl butyral, silicone resin, polyamide resin, epoxy resin, polyacrylic resin, rosin, modified rosin, terpene resin, phenol resin, aliphatic or alicyclic hydrocarbon resins and aromatic petroleum resins.

The binder resin preferably contains a vinyl resin, and more preferably contains a styrene copolymer. These binder resins may be used individually or mixed together.

The binder resin preferably contains carboxyl groups, and is preferably a resin manufactured using a polymerizable monomer containing a carboxyl group. Examples include vinylic carboxylic acids such as acrylic acid, methacrylic acid, α-ethylacrylic acid and crotonic acid; unsaturated dicarboxylic acids such as fumaric acid, maleic acid, citraconic acid and itaconic acid; and unsaturated dicarboxylic acid monoester derivatives such as monoacryloyloxyethyl succinate ester, monomethacryloyloxyethyl succinate ester, monoacryloyloxyethyl phthalate ester and monomethacryloyloxyethyl phthalate ester.

Polycondensates of the carboxylic acid components and alcohol components listed below may be used as the polyester resin. Examples of carboxylic acid components include terephthalic acid, isophthalic acid, phthalic acid, fumaric acid, maleic acid, cyclohexanedicarboxylic acid and trimellitic acid. Examples of alcohol components include bisphenol A, hydrogenated bisphenols, bisphenol A ethylene oxide adduct, bisphenol A propylene oxide adduct, glycerin, trimethyloyl propane and pentaerythritol.

The polyester resin may also be a polyester resin containing a urea group. Preferably the terminal and other carboxyl groups of the polyester resins are not capped.

Crosslinking Agent

To control the molecular weight of the binder resin constituting the toner particle, a crosslinking agent may also be added during polymerization of the polymerizable monomers.

Examples include ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, neopentyl glycol diacrylate, divinyl benzene, bis (4-acryloxypolyethoxyphenyl) propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, diacrylates of polyethylene glycol #200, #400 and #600, dipropylene glycol diacrylate, polypropylene glycol diacrylate, polyester diacrylate (MANDA, Nippon Kayaku Co., Ltd.), and these with methacrylate substituted for the acrylate.

The added amount of the crosslinking agent is preferably from 0.001 mass parts to 15.000 mass parts per 100 mass parts of the polymerizable monomers.

Release Agent

The toner particle may also contain a release agent. Using an ester wax with a melting point in the range from 60° C. to 90° C. in particular, a plasticization effect is easily obtained and the organosilicon polymer particle can be fixed efficiently to the toner particle because the wax is highly compatible with the binder resin.

Examples of ester waxes include waxes consisting primarily of fatty acid esters, such as carnauba wax and montanic acid ester wax; fatty acid esters in which the acid component has been partially or fully deacidified, such as deacidified carnauba wax; hydroxyl group-containing methyl ester compounds obtained by hydrogenation or the like of plant oils and fats; saturated fatty acid monoesters such as stearyl stearate and behenyl behenate; diesterified products of saturated aliphatic dicarboxylic acids and saturated fatty alcohols, such as dibehenyl sebacate, distearyl dodecanedioate and distearyl octadecanedioate; and diesterified products of saturated aliphatic diols and saturated aliphatic monocarboxylic acids, such as nonanediol dibehenate and dodecanediol distearate.

Of these waxes, it is desirable to include a bifunctional ester wax (diester) having two ester bonds in the molecular structure.

A bifunctional ester wax is an ester compound of a dihydric alcohol and an aliphatic monocarboxylic acid, or an ester compound of a divalent carboxylic acid and a fatty monoalcohol.

Specific examples of the aliphatic monocarboxylic acid include myristic acid, palmitic acid, stearic acid, arachidic acid, behenic acid, lignoceric acid, cerotic acid, montanic acid, melissic acid, oleic acid, vaccenic acid, linoleic acid and linolenic acid.

Specific examples of the fatty monoalcohol include myristyl alcohol, cetanol, stearyl alcohol, arachidyl alcohol, behenyl alcohol, tetracosanol, hexacosanol, octacosanol and triacontanol.

Specific examples of the divalent carboxylic acid include butanedioic acid (succinic acid), pentanedioic acid (glutaric acid), hexanedioic acid (adipic acid), heptanedioic acid (pimelic acid), octanedioic acid (suberic acid), nonanedioic acid (azelaic acid), decanedioic acid (sebacic acid), dodecanedioic acid, tridecaendioic acid, tetradecanedioic acid, hexadecanedioic acid, octadecanedioic acid, eicosanedioic acid, phthalic acid, isophthalic acid, terephthalic acid and the like.

Specific examples of the dihydric alcohol include ethylene glycol, propylene glycol, 1,3-propanediol, 1,4-butanediol, 1,5-pentanediol, 1,6-hexanediol, 1,10-decanediol, 1,12-dodecanediol, 1,14-tetradecanediol, 1,16-hexadecanediol, 1,18-octadecanediol, 1,20-eicosanediol, 1,30-triacontanediol, diethylene glycol, dipropylene glycol, 2,2,4-trimethyl-1,3-pentanediol, neopentyl glycol, 1,4-cyclohexane dimethanol, spiroglycol, 1,4-phenylene glycol, bisphenol A, hydrogenated bisphenol A and the like.

Other release agents that can be used include petroleum waxes and their derivatives, such as paraffin wax, microcrystalline wax and petrolatum, montanic wax and its derivatives, hydrocarbon waxes obtained by the Fischer-Tropsch method, and their derivatives, polyolefin waxes such as polyethylene and polypropylene, and their derivatives, natural waxes such as carnauba wax and candelilla wax, and their derivatives, higher fatty alcohols, and fatty acids such as stearic acid and palmitic acid.

The content of the release agent is preferably from 5.0 mass parts to 20.0 mass parts per 100.0 mass parts of the binder resin.

Colorant

A colorant may also be included in the toner. The colorant is not specifically limited, and the following known colorants may be used.

Examples of yellow pigments include yellow iron oxide, Naples yellow, naphthol yellow S, Hansa yellow G, Hansa yellow 10G, benzidine yellow G, benzidine yellow GR, quinoline yellow lake, permanent yellow NCG, condensed azo compounds such as tartrazine lake, isoindolinone compounds, anthraquinone compounds, azo metal complexes, methine compounds and allylamide compounds. Specific examples include:

C.I. pigment yellow 12, 13, 14, 15, 17, 62, 74, 83, 93, 94, 95, 109, 110, 111, 128, 129, 147, 155, 168 and 180.

Examples of red pigments include red iron oxide, permanent red 4R, lithol red, pyrazolone red, watching red calcium salt, lake red C, lake red D, brilliant carmine 6B, brilliant carmine 3B, eosin lake, rhodamine lake B, condensed azo compounds such as alizarin lake, diketopyrrolopyrrole compounds, anthraquinone compounds, quinacridone compounds, basic dye lake compounds, naphthol compounds, benzimidazolone compounds, thioindigo compound and perylene compounds. Specific examples include:

C.I. pigment red 2, 3, 5, 6, 7, 23, 48:2, 48:3, 48:4, 57:1, 81:1, 122, 144, 146, 166, 169, 177, 184, 185, 202, 206, 220, 221 and 254.

Examples of blue pigments include alkali blue lake, Victoria blue lake, phthalocyanine blue, metal-free phthalocyanine blue, phthalocyanine blue partial chloride, fast sky blue, copper phthalocyanine compounds such as indathrene blue BG and derivatives thereof, anthraquinone compounds and basic dye lake compounds. Specific examples include:

C.I. pigment blue 1, 7, 15, 15:1, 15:2, 15:3, 15:4, 60, 62 and 66.

Examples of black pigments include carbon black and aniline black. These colorants may be used individually, or as a mixture, or in a solid solution.

The content of the colorant is preferably from 3.0 mass parts to 15.0 mass parts per 100.0 mass parts of the binder resin.

Charge Control Agent

The toner particle may also contain a charge control agent. A known charge control agent may be used. A charge control agent that provides a rapid charging speed and can stably maintain a uniform charge quantity is especially desirable.

Examples of charge control agents for controlling the negative charge properties of the toner particle include:

organic metal compounds and chelate compounds, including monoazo metal compounds, acetylacetone metal compounds, aromatic oxycarboxylic acids, aromatic dicarboxylic acids, and metal compounds of oxycarboxylic acids and dicarboxylic acids. Other examples include aromatic oxycarboxylic acids, aromatic mono- and polycarboxylic acids and their metal salts, anhydrides and esters, and phenol derivatives such as bisphenols and the like. Further examples include urea derivatives, metal-containing salicylic acid compounds, metal-containing naphthoic acid compounds, boron compounds, quaternary ammonium salts and calixarenes.

Meanwhile, examples of charge control agents for controlling the positive charge properties of the toner particle include nigrosin and nigrosin modified with fatty acid metal salts; guanidine compounds; imidazole compounds; quaternary ammonium salts such as tributylbenzylammonium-1-hydroxy-4-naphthosulfonate salt and tetrabutylammonium tetrafluoroborate, onium salts such as phosphonium salts that are analogs of these, and lake pigments of these; triphenylmethane dyes and lake pigments thereof (using phosphotungstic acid, phosphomolybdic acid, phosphotungstenmolybdic acid, tannic acid, lauric acid, gallic acid, ferricyanic acid or a ferrocyan compound or the like as the laking agent); metal salts of higher fatty acids; and resin charge control agents.

One of these charge control agents alone or a combination of two or more may be used. The addition amount of these charge control agents is preferably from 0.01 mass parts to 10.00 mass parts per 100.00 mass parts of the binder resin.

The methods for measuring the various physical properties of the toner of the present invention are explained below.

Number-Average Particle Diameters of Toner Particle and Organosilicon Polymer Particle The number-average particle diameters of the toner particle and the organosilicon polymer particle are measured using an "S-4800" scanning electron microscope (Hitachi, Ltd.). The toner with the externally added organosilicon polymer is observed, the long diameters of the primary particles of 100 randomly-selected organosilicon polymer particles are measured in a field enlarged to a maximum magnification of 50,000×, and the number-average particle diameter is calculated. The observation magnification is adjusted appropriately according to the size of the organosilicon polymer particles.

For the toner particle, the long diameters of 100 randomly-selected toner particles are measured in a field enlarged to a magnification of 2,000×, and the number-average particle diameter is calculated.

When the original organosilicon polymer particle before external addition is available, it is used to calculate the number-average particle diameter.

Analyzing Organosilicon Polymer Particle and Silanol Derivative Structure in Organosilicon Polymer Particle Pyrolysis gas chromatography mass spectrometry (hereunder called pyrolysis GC/MS) and NMR are used to determine the ratio of the peak areas of T3 unit structures in the organosilicon polymer particles contained in the toner, and to identify the silanol derivative structure ($R^aSi(OH)O_{2/2}$).

When the toner contains a silicon-containing material other than the organosilicon polymer particle, 1 g of the toner is dissolved and dispersed in 31 g of chloroform in a vial. Dispersion is performed for 30 minutes using an ultrasound homogenizer to prepare a liquid dispersion.

Ultrasonic processing unit: VP-050 ultrasound homogenizer (manufactured by Taitec Corporation).

Microchip: Step microchip, tip diameter φ2 mm

Microchip tip position: Center of glass vial and 5 mm above bottom of vial

Ultrasound conditions: Intensity 30%, 30 minutes; ultrasound is applied while cooling the vial with ice water so that the temperature of the dispersion does not rise.

The dispersion is transferred to a glass tube of a swing rotor (50 ml), and centrifuged for 30 minutes at 58.33 $S^{-1}$ with a centrifuge (H-9R; manufactured by Kokusan Co. Ltd.)). After centrifugation, the glass tube contains silicon-containing material other than the organosilicon polymer particle, and a separate residue obtained by removing the silicon-containing material other than the organosilicon polymer particle from the toner. The residue obtained by removing the silicon-containing material other than the organosilicon polymer particle from the toner is extracted, and the chloroform is removed by vacuum drying (40° C./24 hour) to prepare a sample.

The organosilicon polymer particle is then analyzed by pyrolysis GC/MS using either this sample or the original organosilicon polymer particle.

A silanol derivative structure can be identified by analyzing a mass spectrum of the components of a decomposition product derived from the silanol derivative structure, which is produced when the sample or organosilicon polymer particle is pyrolyzed at about 550° C. to 700° C.

Pyrolysis GC/MS Measurement Conditions

Pyrolysis unit: JPS-700 (Japan Analytical Industry Co. Ltd.)

Decomposition temperature: 590° C.

GC/MS unit: Focus GC/ISQ (ThermoFisher)

Column: HP-5Ms, length 60 m, bore 0.25 mm, film thickness 0.25 μm

Injection port temperature: 200° C.

Flow pressure: 100 kPa

Split: 50 ml/min

MS ionization: EI

Ion source temperature: 200° C., mass range 45-650

In the above measurement, the integrated value of peaks derived from the cage-shaped silsesquioxane structure silanol derivative represented by formula (2) above is calculated given 1.000 as the integrated value of peaks derived from the cage-shaped silsesquioxane structures represented by formula (1) above.

The abundance ratios of the constituent compounds of the identified organosilicon polymer particle and the ratio of T3 unit structures in the organosilicon polymer particle are then measured and calculated by solid $^{29}$Si-NMR.

In solid $^{29}$Si-NMR, peaks are detected in different shift regions according to the structures of the functional groups binding to the Si constituting the organosilicon polymer.

The structure binding to Si at each peak can be specified using a standard sample. The abundance ratio of each constituent compound can also be calculated from the resulting peak areas. The ratio of the peak area of T3 unit structures relative to the total peak area can also be determined by calculation.

The measurement conditions for solid $^{29}$Si-NMR are as follows for example.

Unit: JNM-ECX5002 (JEOL RESONANCE Inc.)
Temperature: Room temperature
Measurement method: DDMAS method, $^{29}$Si 45°
Sample tube: Zirconia 3.2 mm φ
Sample: Packed in sample tube in powder form
Sample rotation: 10 kHz
Relaxation delay: 180 s
Scan: 2000

After this measurement, the peaks of the multiple silane components having different substituents and linking groups in the organosilicon polymer particle are separated by curve fitting into the following X1, X2, X3 and X4 structures, and the respective peak areas are calculated.

Note that the X3 structure mentioned below corresponds to the T3 unit structure in the present invention.

X1 structure: $(Ri)(Rj)(Rk)SiO_{1/2}$ (A1)

X2 structure: $(Rg)(Rh)Si(O_{1/2})_2$ (A2)

X3 structure: $RmSi(O_{1/2})_3$ (A3)

X4 structure: $Si(O_{1/2})_4$ (A4)

X1

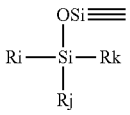

(A1)

X2

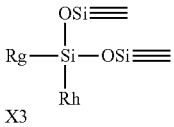

(A2)

X3

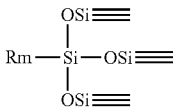

(A3)

X4

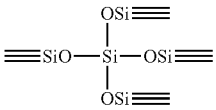

(A4)

The hydrocarbon group represented by $R^a$ above is confirmed by $^{13}$C-NMR.

$^{13}$C-NMR (Solid) Measurement Conditions
Unit: JNM-ECX500II (JEOL RESONANCE Inc.)
Sample tube: 3.2 mm φ
Sample: Packed in sample tube in powder form
Sample temperature: Room temperature
Pulse mode: CP/MAS
Measurement nuclear frequency: 123.25 MHz ($^{13}$C)
Standard substance: Adamantane (external standard: 29.5 ppm)
Sample rotation: 20 kHz
Contact time: 2 ms
Delay time: 2 s
Number of integrations: 1024

In this method, the hydrocarbon group represented by $R^a$ above is confirmed based on the presence or absence of signals attributable to methyl groups (Si—$CH_3$), ethyl groups (Si—$C_2H_5$), propyl groups (Si—$C_3H_7$), butyl groups (Si—$C_4H_9$), pentyl groups (Si—$C_5H_{11}$), hexyl groups (Si—$C_6H_{13}$) or phenyl groups (Si—$C_6H_5$—) bound to silicon atoms.

Assaying Organosilicon Polymer Particle Contained in Toner

The content of the organosilicon polymer particle in the toner can be determined by the following methods.

When the toner contains a silicon-containing material other than the organosilicon polymer particle, 1 g of the toner is dissolved and dispersed in 31 g of chloroform in a vial. Dispersion is performed for 30 minutes using an ultrasound homogenizer to prepare a liquid dispersion.

Ultrasonic processing unit: VP-050 ultrasound homogenizer (manufactured by Taitec Corporation.).

Microchip: Step microchip, tip diameter φ2 mm

Microchip tip position: Center of glass vial and 5 mm above bottom of vial

Ultrasound conditions: Intensity 30%, 30 minutes; ultrasound is applied while cooling the vial with ice water so that the temperature of the dispersion does not rise.

The dispersion is transferred to a glass tube of a swing rotor (50 ml), and centrifuged for 30 minutes at 58.33 $S^{-1}$ with a centrifuge (H-9R; manufactured by Kokusan Co. Ltd.). After centrifugation, the glass tube contains silicon-containing material other than the organosilicon polymer particle, and a separate residue obtained by removing the silicon-containing material other than the organosilicon polymer particle from the toner. The residue obtained by removing the silicon-containing material other than the organosilicon polymer particle from the toner is extracted, and the chloroform is removed by vacuum drying (40° C./24 hours) to prepare a sample.

The above steps are repeated to prepare 4 g of a dried sample. This is pelletized, and the silicon content is determined by fluorescence X-ray.

Fluorescence X-ray measurement is performed in accordance with JIS K 0119-1969, specifically as follows.

An "Axios" wavelength dispersive fluorescence X-ray spectrometer (manufactured by PANalytical) is used as the measurement unit with the accessory "SuperQ ver. 5.0 L" dedicated software (manufactured by PANalytical) for setting the measurement conditions and analyzing the measurement data. An Rh anode is used for the X-ray tube and vacuum as the measurement atmosphere, and the measurement diameter (collimator mask diameter) is 27 mm.

The elements in the range of F to U are measured by the Omnian method, and detection is performed with a proportional counter (PC) for light elements and a scintillation counter (SC) for heavy elements. The acceleration voltage and current value of the X-ray generator are set so that the output is 2.4 kW. For the measurement sample, 4 g of sample is placed in a dedicated aluminum pressing ring, smoothed flat, and then pressed for 60 seconds at 20 MPa with a "BRE-32" tablet molding machine (manufactured by Maekawa Testing Machine Mfg. Co., Ltd.) to mold a pellet 2 mm thick and 39 mm in diameter.

Measurement is performed under the above conditions to identify each element based on its peak position in the resulting X-ray, and the mass ratio of each element is calculated from the count rate (unit: cps), which is the number of X-ray photons per unit time.

For the analysis, the mass ratios of all elements contained in the sample are calculated by the FP assay method, and silicon content of the toner is determined. In the FP assay method, the balance is set according to the binder resin of the toner.

The content of the organosilicon polymer particle in the toner can be calculated from the relationship between the silicon content of the toner as determined by fluorescence X-ray and the content ratio of silicon in the constituent compounds of the organosilicon polymer particle, the structure of which has been specified by solid $^{29}$SiNMR, pyrolysis GC/MS and the like.

Content of Polyvalent Metal Element in Toner Particle (ICP-AES)

The content of the polyvalent metal element in the toner particle is assayed with an inductively coupled plasma atomic emission spectroscope (ICP-AES; manufactured by Seiko Instruments, Inc.).

As a pre-treatment, 100.0 mg of the toner particle is acid degraded with 8.00 ml of 60% nitric acid (for atomic absorption analysis, manufactured by Kanto Chemical Co., Inc.).

Acid degradation is performed for 1 hour in a sealed container at an internal temperature of 220° C. with an ETHOS 1600 high-performance microwave digestion system (Milestone General K.K.) to prepare a sample solution containing the polyvalent metal element.

Ultrapure water is then added to a total of 50.00 g to obtain a measurement sample. A calibration curve is prepared for the polyvalent metal element, and the amount of metal contained in each sample is assayed. A sample prepared by adding ultrapure water to 8.00 ml of nitric acid to a total of 50.00 g is also measured as a blank, and the metal quantity of the blank is subtracted.

Acid Value of Resin

The acid value is the number of mg of potassium hydroxide needed to neutralize the acid contained in 1 g of sample. The acid value is measured in accordance with JIS K 0070-1992, specifically by the following procedures.

Titration is performed with a 0.1 mol/L potassium hydroxide ethyl alcohol solution (manufactured by Kishida Chemical Co. Ltd.). The factor of the potassium hydroxide ethyl alcohol solution can be determined with a potentiometric titration apparatus (AT-510 automatic potentiometric titration apparatus; manufactured by Kyoto Electronics Manufacturing Co. Ltd.). 100 ml of 0.100 mol/L hydrochloric acid is taken in a 250 ml tall beaker and titrated with the potassium hydroxide ethyl alcohol solution, and the amount of the potassium hydroxide ethyl alcohol solution required for neutralization is determined. The 0.100 mol/L hydrochloric acid has been prepared in accordance with JIS K 8001-1998.

The measurement conditions for acid value measurement are shown below.

Titration unit: AT-510 potentiometric titration apparatus (manufactured by Kyoto Electronics Manufacturing. Co. Ltd.)

Electrode: Double-junction type composite glass electrode (manufactured by Kyoto Electronics Manufacturing. Co. Ltd.)

Titration unit control software: AT-WIN

Titration analysis software: Tview

The titration parameters and control parameters during titration are set as follows.

Titration Parameters

Titration mode: Blank titration

Titration format: Total titration

Maximum titration amount: 20 ml

Waiting time before titration: 30 seconds

Titration direction: Automatic

Control Parameters

End point judgment potential: 30 dE

End point judgment potential value: 50 dE/dml

End point detection judgment: Not set

Control speed mode: Standard

Gain: 1

Data collection potential: 4 mV

Data collection titration amount: 0.1 ml

Main Test 0.100 g of the measurement sample is weighed exactly into a 250 ml tall beaker, 150 ml of a toluene/ethanol (3:1) mixed solution is added, and the sample is dissolved over the course of 1 hour. This is then titrated with the above potentiometric titration apparatus using the above potassium hydroxide ethyl alcohol solution.

Blank Test

Titration is performed by the above operations except that no sample is used (that is, using only a mixed toluene: ethanol solution (3:1)).

The results are then entered into the following formula to calculate the acid value:

$$A=[(C-B)\times f\times 5.611]/S$$

(in which A is the acid value (mg KOH/g), B is the added amount (ml) of the potassium hydroxide ethyl alcohol solution in the blank test, C is the added amount (ml) of the potassium hydroxide ethyl alcohol solution in the main test, f is the factor of the potassium hydroxide solution, and S is the mass (g) of the sample).

Measuring Weight-Average Particle Diameter (D4) of Toner Particle

The particle diameter of the toner particle can be measured by the pore electrical resistance method. For example, it may be measured and calculated using a "Multisizer 3 Coulter Counter" together with the accessory dedicated Multisizer 3 Version 3.51 software (manufactured by Beckman Coulter Inc.).

A "Multisizer (R) 3 Coulter Counter" precise particle size distribution analyzer (Beckman Coulter, Inc.) based on the pore electrical resistance method is used together with the dedicated "Beckman Coulter Multisizer 3 Version 3.51" software (Beckman Coulter, Inc.). Using an aperture diameter of 100 μm, measurement is performed with 25,000 effective measurement channels, and the measurement data are analyzed to calculate the particle diameter.

The aqueous electrolytic solution used in measurement may be a solution of special grade sodium chloride dissolved in ion-exchange water to a concentration of about 1 mass %, such as "ISOTON II" (Beckman Coulter, Inc.), for example. The following settings are performed on the dedicated software prior to measurement and analysis.

On the "Change standard measurement method (SOM)" screen of the dedicated software, the total count number in control mode is set to 50000 particles, the number of measurements to 1, and the Kd value to a value obtained with "Standard particles 10.0 μm" (Beckman Coulter, Inc.). The threshold and noise level are set automatically by pushing the threshold/noise level measurement button. The current is set to 1600 μA, the gain to 2, and the electrolyte solution to ISOTON II, and a check is entered for aperture tube flush after measurement.

On the "Conversion settings from pulse to particle diameter" screen of the dedicated software, the bin interval is set to the logarithmic particle diameter, the particle diameter bins to 256, and the particle diameter range to from 2 μm to 60 μm.

The specific measurement methods are as follows.

(1) About 200 mL of the aqueous electrolytic solution is added to a dedicated 250 mL glass round-bottomed beaker of the Multisizer 3, the beaker is set on the sample stand, and stirring is performed with a stirrer rod counter-clockwise at a rate of 24 rps. Contamination and bubbles in the aperture tube are then removed by the "Aperture tube flush" function of the dedicated software.

(2) 30 mL of the same aqueous electrolytic solution is placed in a 100 mL glass flat-bottomed beaker, and about 0.3 mL of a dilution of "Contaminon N" (a 10% by mass aqueous solution of a neutral detergent for washing precision instruments, Wako Pure Chemical Industries, Ltd.) diluted 3-fold by mass with ion-exchange water is added.

(3) A predetermined amount of ion-exchange water and about 2 mL of Contaminon N are added to the water tank of an ultrasonic disperser "Ultrasonic Dispersion System Tetra150" (Nikkaki Bios Co., Ltd.) with an electrical output of 120 W equipped with two built-in oscillators having an oscillating frequency of 50 kHz with their phases shifted by 180° from each other.

(4) The beaker of (2) above is set in the beaker-fixing hole of the ultrasonic disperser, and the ultrasonic disperser is operated. The height position of the beaker is adjusted so as to maximize the resonant condition of the liquid surface of the aqueous electrolytic solution in the beaker.

(5) The aqueous electrolytic solution in the beaker of (4) above is exposed to ultrasound as about 10 mg of toner (particles) is added bit by bit to the aqueous electrolytic solution, and dispersed. Ultrasound dispersion is then continued for a further 60 seconds. During ultrasound dispersion, the water temperature in the tank is adjusted appropriately to from 10° C. to 40° C.

(6) The aqueous electrolytic solution of (5) above with the toner (particles) dispersed therein is dripped with a pipette into the round-bottomed beaker of (1) above set on the sample stand, and adjusted to a measurement concentration of about 5%. Measurement is then performed until the number of measured particles reaches 50000.

(7) The measurement data is analyzed with the dedicated software included with the apparatus, and the weight-average particle diameter (D4) is calculated. The weight-average particle diameter (D4) is the "Average diameter" on the analysis/volume statistical value (arithmetic mean) screen when graph/volume % is set in the dedicated software.

EXAMPLES

The invention is explained in more detail below based on examples and comparative examples, but the invention is in no way limited to these. Unless otherwise specified, parts in the examples are based on mass.

Preparation of Resin Particle Dispersion 1

78.0 parts of styrene, 20.7 parts of butyl acrylate, 1.3 parts of acrylic acid as a monomer providing carboxyl groups and 3.2 parts of n-lauryl mercaptane were mixed and dissolved. An aqueous solution of 1.5 parts of Neogen RK (manufactured by DKS Co., Ltd.) in 150 parts of ion-exchange water was then added to this solution, and dispersed.

This was then stirred slowly for 10 minutes as an aqueous solution of 0.3 parts of potassium persulfate in 10 parts of ion-exchange water was added. After nitrogen purging, emulsion polymerization was performed for 6 hours at 70° C. After completion of polymerization, the reaction solution was cooled to room temperature, and ion-exchange water was added to obtain a resin particle dispersion 1 with a solids concentration of 12.5 mass % and a volume-based median particle diameter of 0.2 μm.

To measure the acid value, a part of the resulting resin particle 1 was washed with pure water to remove the surfactant, and dried under reduced pressure. The acid value of the resin was measured and confirmed to be 9.5 mg KOH/g.

Preparation of Resin Particle Dispersion 2

A resin particle dispersion 2 was obtained in the same way as the resin particle dispersion 1 except that the amount of butyl acrylate was changed to 21.6 parts and the amount of acrylic acid was changed to 0.4 parts. The resulting resin particle dispersion 2 had a volume-based median particle diameter of 0.2 μm, and the acid value of the resin was confirmed to be 3.0 mg KOH/g.

Preparation of Resin Particle Dispersion 3

A resin particle dispersion 3 was obtained in the same way as the resin particle dispersion 1 except that the amount of butyl acrylate was changed to 17.5 parts and the amount of acrylic acid was changed to 4.5 parts. The resulting resin particle dispersion 3 had a volume-based median particle diameter of 0.2 μm, and the acid value of the resin was confirmed to be 38.0 mg KOH/g.

Preparation of Organosilicon Polymer Particle 1

Step 1

360 parts of water were placed in a reactor equipped with a thermometer and a stirrer, and 17 parts of 5.0 mass % hydrochloric acid were added to obtain a uniform solution. This was stirred at 25° C. as 136 parts of methyl trimethoxysilane were added, stirred for 5 hours, and then filtered to obtain a clear reaction solution containing a silanol compound or partial condensate thereof.

Step 2

540 parts of water were placed in a reactor equipped with a thermometer, a stirrer and a dripping mechanism, and 19 parts of 10.0 mass % ammonia water were added to obtain a uniform solution. This was stirred at 30° C. as 100 parts of the reaction solution obtained in Step 1 were dripped in over the course of 0.33 hours, and then stirred for 6 hours to obtain a suspension. The resulting suspension was centrifuged to precipitate and remove fine particles, which were then dried for 24 hours in a drier at 180° C. to obtain an organosilicon polymer particle 1.

Pyrolysis GC/MS and NMR of the organosilicon polymer particle 1 showed that it was a silanol derivative having a silsesquioxane structure. The number-average particle diameter of the primary particles was 150 nm. The physical properties are shown in Table 1.

Preparation of Organosilicon Polymer Particles 2 to 9

Organosilicon polymer particles 2 to 9 were obtained as in the manufacturing example of the organosilicon polymer particle 1 except that the added amount of the catalyst, the dripping time and the like were changed as shown in Table 1. The physical properties are shown in Table 1.

TABLE 1

| Organosilicon polymer particle No. | Step 1 Water Parts | Step 1 Hydrochloric acid Parts | Step 1 Reaction temperature ° C. | Step 1 Trifunctional silane Name | Step 1 Trifunctional silane Parts | Step 2 Reaction solution obtained in Step 1 Parts | Step 2 Water Parts | Step 2 Arnmonia water Parts | Step 2 Reaction initiation temperature ° C. | Step 2 Dripping time h |
|---|---|---|---|---|---|---|---|---|---|---|
| 1 | 360 | 17 | 25 | Methyl trimethoxysilane | 136 | 100 | 540 | 19 | 30 | 0.33 |
| 2 | 360 | 15.5 | 25 | Methyl trimethoxysilane | 136 | 100 | 540 | 17.5 | 30 | 0.45 |
| 3 | 360 | 16.5 | 25 | Methyl trimethoxysilane | 136 | 100 | 540 | 18.5 | 30 | 0.40 |
| 4 | 360 | 20 | 25 | Methyl trimethoxysilane | 136 | 100 | 540 | 21 | 30 | 0.25 |
| 5 | 360 | 21.5 | 25 | Methyl trimethoxysilane | 136 | 100 | 540 | 22 | 30 | 0.21 |
| 6 | 360 | 23 | 25 | Methyl trimethoxysilane | 136 | 100 | 540 | 23 | 30 | 0.17 |
| 7 | 360 | 23 | 25 | Methyl trimethoxysilane | 136 | 100 | 540 | 24 | 30 | 0.13 |
| 8 | 360 | 15 | 25 | Methyl trimethoxysilane | 136 | 100 | 540 | 17 | 30 | 0.5 |
| 9 | 360 | 24 | 25 | Methyl trimethoxysilane | 136 | 100 | 540 | 25 | 30 | 0.11 |

| Organosilicon polymer particle No. | Physical properties Number-average particle diameter nm | Physical properties Integral value of peaks derived from silanol derivative with cage-shaped silsesquioxane structure | Physical properties Peak area ratio of T3 unit structures |
|---|---|---|---|
| 1 | 150 | 0.005 | 1.00 |
| 2 | 110 | 0.005 | 1.00 |
| 3 | 130 | 0.005 | 1.00 |
| 4 | 250 | 0.005 | 1.00 |
| 5 | 300 | 0.005 | 1.00 |
| 6 | 350 | 0.005 | 1.00 |
| 7 | 420 | 0.005 | 1.00 |
| 8 | 100 | 0.005 | 1.00 |
| 9 | 450 | 0.005 | 1.00 |

Preparing Release Agent Dispersion 100 parts of a release agent (behenyl behenate, melting point 72.1° C.) and 15 parts of Neogen RK were mixed with 385 parts of ion-exchange water, and dispersed for about 1 hour with a wet type jet mill unit JN100 (Jokoh Co., Ltd.) to obtain a release agent dispersion. The solids concentration of the release agent dispersion was 20 mass %.

Preparation of Colorant Dispersion 100 parts of carbon black "Nipex35 (Orion Engineered Carbons)" as a colorant and 15 parts of Neogen RK were mixed with 885 parts of ion-exchange water, and dispersed for about 1 hour in a wet type jet mill unit JN100 to obtain a colorant dispersion.

Toner 1 Preparation Example

Preparation Example of Toner Particle 1

265 parts of the resin particle dispersion 1, 10 parts of the release agent dispersion and 10 parts of the colorant-dispersed solution were dispersed with a homogenizer (IKA Ultra-Turrax T50; manufactured by IKA Japan K.K.). This was stirred as the temperature inside the container was adjusted to 30° C., and 1 mol/L sodium hydroxide aqueous solution was added to adjust the pH to 8.0.

An aqueous solution of 0.08 parts of aluminum chloride dissolved in 10 parts of ion-exchange water was added at 30° C. under stirring over the course of 10 minutes as a flocculant. This was left standing for 3 minutes before initiating temperature rise, and the temperature was raised to 50° C. to produce aggregated particles. The particle diameters of the aggregated particles were measured in this state with a "Multisizer™ 3 Coulter Counter" (manufactured by Beckman Coulter Inc.). Once the weight-average particle diameter had reached 7.2 μm, 0.9 parts of sodium chloride and 5.0 parts of Neogen RK were added to arrest particle growth.

1 mol/L sodium hydroxide aqueous solution was added to adjust the pH to 9.0, after which the temperature was raised to 95° C. to spheroidize the aggregated particles. Once the average circularity had reached 0.980, temperature decrease was initiated, and the mixture was cooled to room temperature to obtain a toner particle dispersion 1.

Hydrochloric acid was added to the resulting toner particle dispersion 1 to adjust the pH to 1.5 or less, and the dispersion was stirred for one hour, left standing, and subjected to solid-liquid separation with a pressure filtration unit to obtain a toner cake. This was re-slurried with ion-exchange water to once again obtain a dispersion, and then subjected to solid-liquid separation with the same filtration unit. Re-slurrying and solid-liquid separation were repeated until the electrical conductivity of the filtrate was not more than 5.0 μS/cm, after which a final solid-liquid separation was performed to obtain a toner cake. The resulting toner cake was dried, and then classified with a classifier to obtain a toner particle 1. The number-average particle diameter of the primary particles of the toner particle 1 was 6.5 μm.

External Addition Step 0.10 parts of the organosilicon polymer particle 1 and 1.0 part of a hydrophobic silica fine powder (BET specific surface area 150 $m^2/g$, obtained by hydrophobically treating 100 parts of silica fine powder with 30 parts of hexamethyl disilazane (HMDS) and 10 parts of dimethyl silicone oil) were added to 100.00 parts of the toner particle 1 obtained above in an FM mixer (FM10C; manufactured by Nippon Coke & Engineering Co., Ltd.) with 7° C. water in the jacket.

Once the water temperature in the jacket had stabilized at 7° C.±1° C., this was mixed for 5 minutes with a 38 m/sec peripheral speed of the rotating blade, to obtain a toner mixture 1.

The amount of water passing through the jacket was adjusted appropriately during this process so that the temperature in the FM mixer tank did not exceed 25° C.

The resulting toner mixture 1 was sieved with a 75 μm mesh sieve to obtain a toner 1. The manufacturing conditions and physical properties of the toner 1 are shown in Table 2.

Preparation Examples of Toners 2 to 17 and 25 to 33 and Comparative Toners 1 to 5

Toners 2 to 17 and 25 to 33 and comparative toners 1 to 5 were obtained as in the preparation example of the toner 1 except that the conditions were changed as shown in Table 2. The physical properties are shown in Table 2.

Toner 18 Preparation Example

Preparation Example of Toner Particle 18

265 parts of the resin particle dispersion 1, 10 parts of the release agent dispersion and 10 parts of the colorant-dispersed solution were dispersed with a homogenizer (Ultra-Turrax T50; manufactured by IKA Japan K.K.). This was stirred as the temperature inside the container was adjusted to 30° C., and 1 mol/L sodium hydroxide aqueous solution was added to adjust the pH to 8.0.

An aqueous solution of 0.22 parts of aluminum chloride dissolved in 10 parts of ion-exchange water was added at 30° C. under stirring over the course of 10 minutes as a flocculant. This was left standing for 3 minutes before initiating temperature rise, and the temperature was raised to 50° C. to produce aggregated particles. The particle diameters of the aggregated particles were measured in this state with a "Multisizer™ 3 Coulter Counter" (manufactured by Beckman Coulter Inc.). Once the weight-average particle diameter had reached 5.0 μm, 0.9 parts of sodium chloride and 5.0 parts of Neogen RK were added to arrest particle growth.

1 mol/L sodium hydroxide aqueous solution was added to adjust the pH to 9.0, after which the temperature was raised to 95° C. to spheroidize the aggregated particles. Once the average circularity had reached 0.980, temperature decrease was initiated, and the mixture was cooled to room temperature to obtain a toner particle dispersion 18.

Hydrochloric acid was added to the resulting toner particle dispersion 18 to adjust the pH to 1.5 or less, and the dispersion was stirred for one hour, left standing, and subjected to solid-liquid separation with a pressure filtration unit to obtain a toner cake. This was re-slurried with ion-exchange water to once again obtain a dispersion, and then subjected to solid-liquid separation with the same filtration unit. Re-slurrying and solid-liquid separation were repeated until the electrical conductivity of the filtrate was not more than 5.0 μS/cm, after which final solid-liquid separation was performed to obtain a toner cake. The resulting toner cake was dried, and then classified with a classifier to obtain a toner particle 18. The number-average particle diameter of the primary particles of the toner particle 18 was 4.5 μm.

The subsequent steps were performed as in the manufacturing example of the toner 1 except that the conditions were changed as shown in Table 2, to obtain a toner 18.

Toner 19

Preparation Example of Toner Particle 19

265 parts of the resin particle dispersion 1, 10 parts of the release agent dispersion and 10 parts of the colorant-dispersed solution were dispersed with a homogenizer (Ultra-Turrax T50; manufactured by IKA Japan K.K.). This was stirred as the temperature inside the container was adjusted to 30° C., and 1 mol/L sodium hydroxide aqueous solution was added to adjust the pH to 8.0.

An aqueous solution of 0.22 parts of aluminum chloride dissolved in 10 parts of ion-exchange water was added at 30° C. under stirring over the course of 10 minutes as a flocculant. This was left standing for 3 minutes before initiating temperature rise, and the temperature was raised to 50° C. to produce aggregated particles. The particle diameters of the aggregated particles were measured in this state with a "Multisizer™ 3 Coulter Counter" (manufactured by Beckman Coulter Inc.). Once the weight-average particle diameter had reached 5.5 μm, 0.9 parts of sodium chloride and 5.0 parts of Neogen RK were added to arrest particle growth.

1 mol/L sodium hydroxide aqueous solution was added to adjust the pH to 9.0, after which the temperature was raised to 95° C. to spheroidize the aggregated particles. Once the average circularity had reached 0.980, temperature decrease was initiated, and the mixture was cooled to room temperature to obtain a toner particle dispersion 19.

Hydrochloric acid was added to the resulting toner particle dispersion 19 to adjust the pH to 1.5 or less, and the dispersion was stirred for one hour, left standing, and subjected to solid-liquid separation with a pressure filtration unit to obtain a toner cake. This was re-slurried with ion-exchange water to once again obtain a dispersion, and then subjected to solid-liquid separation with the same filtration unit. Re-slurrying and solid-liquid separation were repeated until the electrical conductivity of the filtrate was not more than 5.0 μS/cm, after which final solid-liquid separation was performed to obtain a toner cake. The resulting toner cake was dried, and then classified with a classifier to obtain a toner particle 19. The number-average particle diameter of the primary particles of the toner particle 19 was 5.0 μm.

The subsequent steps were performed as in the manufacturing example of the toner 1 except that the conditions were changed as shown in Table 2, to obtain a toner 19.

Toner 20

Preparation Example of Toner Particle 20

265 parts of the resin particle dispersion 1, 10 parts of the release agent dispersion and 10 parts of the colorant-dispersed solution were dispersed with a homogenizer (Ultra-Turrax T50; manufactured by IKA Japan K.K.). This was stirred as the temperature inside the container was adjusted to 30° C., and 1 mol/L sodium hydroxide aqueous solution was added to adjust the pH to 8.0.

An aqueous solution of 0.22 parts of aluminum chloride dissolved in 10 parts of ion-exchange water was added at 30° C. under stirring over the course of 10 minutes as a flocculant. This was left standing for 3 minutes before initiating temperature rise, and the temperature was raised to 50° C. to produce aggregated particles. The particle diameters of the aggregated particles were measured in this state with a "Multisizer™ 3 Coulter Counter" (manufactured by Beckman Coulter Inc.). Once the weight-average particle diameter had reached 10.2 μm, 0.9 parts of sodium chloride and 5.0 parts of Neogen RK were added to arrest particle growth.

1 mol/L sodium hydroxide aqueous solution was added to adjust the pH to 9.0, after which the temperature was raised to 95° C. to spheroidize the aggregated particles. Once the average circularity had reached 0.980, temperature decrease was initiated, and the mixture was cooled to room temperature to obtain a toner particle dispersion 20.

Hydrochloric acid was added to the resulting toner particle dispersion 20 to adjust the pH to 1.5 or less, and the dispersion was stirred for one hour, left standing, and subjected to solid-liquid separation with a pressure filtration unit to obtain a toner cake. This was re-slurried with ion-exchange water to once again obtain a dispersion, and then subjected to solid-liquid separation with the same filtration unit. Re-slurrying and solid-liquid separation were repeated until the electrical conductivity of the filtrate was not more than 5.0 μS/cm, after which final solid-liquid separation was performed to obtain a toner cake. The resulting toner cake was dried, and then classified with a classifier to obtain a toner particle 20. The number-average particle diameter of the primary particles of the toner particle 20 was 9.0 μm.

The subsequent steps were performed as in the manufacturing example of the toner 1 except that the conditions were changed as shown in Table 2, to obtain a toner 20.

Toner 21

Preparation Example of Toner Particle 21

265 parts of the resin particle dispersion 1, 10 parts of the release agent dispersion and 10 parts of the colorant-dispersed solution were dispersed with a homogenizer (Ultra-Turrax T50; manufactured by IKA Japan K.K.). This was stirred as the temperature inside the container was adjusted to 30° C., and 1 mol/L sodium hydroxide aqueous solution was added to adjust the pH to 8.0.

An aqueous solution of 0.22 parts of aluminum chloride dissolved in 10 parts of ion-exchange water was added at 30° C. under stirring over the course of 10 minutes as a flocculant. This was left standing for 3 minutes before initiating temperature rise, and the temperature was raised to 50° C. to produce aggregated particles. The particle diameters of the aggregated particles were measured in this state with a "Multisizer™ 3 Coulter Counter" (manufactured by Beckman Coulter Inc.). Once the weight-average particle diameter had reached 11.3 μm, 0.9 parts of sodium chloride and 5.0 parts of Neogen RK were added to arrest particle growth.

1 mol/L sodium hydroxide aqueous solution was added to adjust the pH to 9.0, after which the temperature was raised to 95° C. to spheroidize the aggregated particles. Once the average circularity had reached 0.980, temperature decrease was initiated, and the mixture was cooled to room temperature to obtain a toner particle dispersion 21.

Hydrochloric acid was added to the resulting toner particle dispersion 21 to adjust the pH to 1.5 or less, and the dispersion was stirred for one hour, left standing, and subjected to solid-liquid separation with a pressure filtration unit to obtain a toner cake. This was re-slurried with ion-exchange water to once again obtain a dispersion, and then subjected to solid-liquid separation with the same filtration unit. Re-slurrying and solid-liquid separation were repeated until the electrical conductivity of the filtrate was not more than 5.0 μS/cm, after which final solid-liquid separation was performed to obtain a toner cake. The resulting toner cake was dried, and then classified with a classifier to obtain a toner particle 21. The number-average particle diameter of the primary particles of the toner particle 21 was 10.0 μm.

The subsequent steps were performed as in the manufacturing example of the toner 1 except that the conditions were changed as shown in Table 2, to obtain a toner 21.

Preparation Example of Toner 22

Preparation Example of Toner Particle 22

245 parts of the resin particle dispersion 1, 10 parts of the release agent dispersion and 10 parts of the colorant-dispersed solution were dispersed with a homogenizer (Ultra-Turrax T50; manufactured by IKA Japan K.K.). This was stirred as the temperature inside the container was adjusted to 30° C., and 1 mol/L sodium hydroxide aqueous solution was added to adjust the pH to 8.0.

An aqueous solution of 0.17 parts of aluminum chloride dissolved in 10 parts of ion-exchange water was added at 30° C. under stirring over the course of 10 minutes as a flocculant. This was left standing for 3 minutes before initiating temperature rise, and the temperature was raised to 50° C. to produce aggregated particles. The particle diameters of the aggregated particles were measured in this state with a "Multisizer™ 3 Coulter Counter" (manufactured by Beckman Coulter Inc.). Once the weight-average particle diameter had reached 7.0 μm, 20 parts of the resin particle dispersion 1 were added as a surface layer resin (surface layer resin addition step).

An aqueous solution of 0.05 parts of aluminum chloride dissolved in 10 parts of ion-exchange water was further added over the course of 10 minutes. Once the weight-average particle diameter had reached 7.2 μm, 0.9 parts of sodium chloride and 5.0 parts of Neogen RK were added to arrest particle growth. 1 mol/L sodium hydroxide aqueous solution was added to adjust the pH to 9.0, after which the temperature was raised to 95° C. to spheroidize the aggregated particles. Once the average circularity had reached 0.980, temperature decrease was initiated, and the mixture was cooled to room temperature to obtain a toner particle dispersion 22.

Hydrochloric acid was added to the resulting toner particle dispersion 22 to adjust the pH to 1.5 or less, and the dispersion was stirred for one hour, left standing, and subjected to solid-liquid separation with a pressure filtration unit to obtain a toner cake. This was re-slurried with ion-exchange water to once again obtain a dispersion, and then subjected to solid-liquid separation with the same filtration unit. Re-slurrying and solid-liquid separation were repeated until the electrical conductivity of the filtrate was not more than 5.0 μS/cm, after which final solid-liquid separation was performed to obtain a toner cake. The resulting toner cake was dried, and then classified with a classifier to obtain a toner particle 22. The number-average particle diameter of the primary particles of the toner particle 22 was 6.5 μm.

The subsequent steps were performed as in the manufacturing example of the toner 1 except that the conditions were changed as shown in Table 2, to obtain a toner 22.

Preparation Example of Toner 23

A toner 23 was obtained as in the manufacturing example of the toner 22 except that the resin particle dispersion 2 was used instead of the resin particle dispersion 1 in the surface layer resin addition step.

Preparation Example of Toner 24

A toner 24 was obtained as in the manufacturing example of the toner 22 except that the resin particle dispersion 3 was used instead of the resin particle dispersion 1 in the surface layer resin addition step.

TABLE 2

| | Toner particle | | | | | Organosilicon polymer particle | | | | | |
|---|---|---|---|---|---|---|---|---|---|---|---|
| Toner No. | Polyvalent metal element | Parts | Content of metal element (μmol/g) | Number-average particle diameter A (μm) | Surface layer | No. | Parts | Content (parts) | Number-average particle diameter B (nm) | R (B/A) | X μmol |
| 1 | Aluminum | 0.08 | 0.080 | 6.50 | — | 1 | 0.10 | 0.10 | 150 | 0.0231 | 80 |
| 2 | Aluminum | 0.35 | 0.400 | 6.50 | — | 1 | 0.10 | 0.10 | 150 | 0.0231 | 400 |
| 3 | Aluminum | 0.15 | 0.100 | 6.50 | — | 1 | 0.10 | 0.10 | 150 | 0.0231 | 100 |
| 4 | Aluminum | 0.30 | 0.320 | 6.50 | — | 1 | 0.10 | 0.10 | 150 | 0.0231 | 320 |
| 5 | Aluminum | 0.22 | 0.200 | 6.50 | — | 1 | 0.10 | 0.10 | 150 | 0.0231 | 200 |
| 6 | Aluminum | 0.22 | 0.200 | 6.50 | — | 1 | 0.20 | 0.20 | 150 | 0.0231 | 100 |
| 7 | Aluminum | 0.22 | 0.200 | 6.50 | — | 1 | 1.00 | 1.00 | 150 | 0.0231 | 20 |
| 8 | Aluminum | 0.22 | 0.200 | 6.50 | — | 1 | 2.00 | 2.00 | 150 | 0.0231 | 10 |
| 9 | Aluminum | 0.22 | 0.200 | 6.50 | — | 1 | 3.00 | 3.00 | 150 | 0.0231 | 7 |
| 10 | Aluminum | 0.22 | 0.200 | 6.50 | — | 1 | 5.00 | 5.00 | 150 | 0.0231 | 4 |
| 11 | Aluminum | 0.22 | 0.200 | 6.50 | — | 1 | 6.00 | 6.00 | 150 | 0.0231 | 3 |
| 12 | Aluminum | 0.22 | 0.200 | 6.50 | — | 2 | 0.20 | 0.20 | 110 | 0.0169 | 100 |
| 13 | Aluminum | 0.22 | 0.200 | 6.50 | — | 3 | 0.20 | 0.20 | 130 | 0.0200 | 100 |
| 14 | Aluminum | 0.22 | 0.200 | 6.50 | — | 4 | 0.20 | 0.20 | 250 | 0.0308 | 100 |
| 15 | Aluminum | 0.22 | 0.200 | 6.50 | — | 5 | 0.20 | 0.20 | 300 | 0.0462 | 100 |
| 16 | Aluminum | 0.22 | 0.200 | 6.50 | — | 6 | 0.20 | 0.20 | 350 | 0.0538 | 100 |
| 17 | Aluminum | 0.22 | 0.200 | 6.50 | — | 7 | 0.20 | 0.20 | 420 | 0.0646 | 100 |
| 18 | Aluminum | 0.22 | 0.200 | 4.50 | — | 1 | 0.20 | 0.20 | 150 | 0.0333 | 100 |
| 19 | Aluminum | 0.22 | 0.200 | 5.00 | — | 1 | 0.20 | 0.20 | 150 | 0.0300 | 100 |
| 20 | Aluminum | 0.22 | 0.200 | 9.00 | — | 4 | 0.20 | 0.20 | 250 | 0.0278 | 100 |
| 21 | Aluminum | 0.22 | 0.200 | 10.00 | — | 4 | 0.20 | 0.20 | 250 | 0.0250 | 100 |
| 22 | Aluminum | 0.22 | 0.200 | 6.50 | Resin particle 1 | 1 | 0.20 | 0.20 | 150 | 0.0231 | 100 |
| 23 | Aluminum | 0.22 | 0.200 | 6.50 | Resin particle 2 | 1 | 0.20 | 0.20 | 150 | 0.0231 | 100 |
| 24 | Aluminum | 0.22 | 0.200 | 6.50 | Resin particle 3 | 1 | 0.20 | 0.20 | 150 | 0.0231 | 100 |
| 25 | Magnesium | 0.70 | 2.000 | 6.50 | — | 1 | 0.10 | 0.10 | 150 | 0.0231 | 2000 |
| 26 | Magnesium | 1.90 | 20.000 | 6.50 | — | 1 | 0.30 | 0.30 | 150 | 0.0231 | 6667 |
| 27 | Magnesium | 0.80 | 5.000 | 6.50 | — | 1 | 1.00 | 1.00 | 150 | 0.0231 | 500 |
| 28 | Magnesium | 1.20 | 10.000 | 6.50 | — | 1 | 1.00 | 1.00 | 150 | 0.0231 | 1000 |
| 29 | Magnesium | 1.50 | 15.000 | 6.50 | — | 1 | 0.30 | 0.30 | 150 | 0.0231 | 5000 |
| 30 | Iron | 0.20 | 0.250 | 6.50 | — | 1 | 0.10 | 0.10 | 150 | 0.0231 | 250 |
| 31 | Iron | 0.50 | 1.250 | 6.50 | — | 1 | 0.10 | 0.10 | 150 | 0.0231 | 1250 |
| 32 | Iron | 0.30 | 0.500 | 6.50 | — | 1 | 0.10 | 0.10 | 150 | 0.0231 | 500 |
| 33 | Iron | 0.40 | 1.000 | 6.50 | — | 1 | 0.10 | 0.10 | 150 | 0.0231 | 1000 |
| C. 1 | Aluminum | 0.05 | 0.040 | 6.50 | — | 1 | 0.10 | 0.10 | 150 | 0.0231 | 40 |
| C. 2 | Magnesium | 2.50 | 26.000 | 6.50 | — | 1 | 0.30 | 0.30 | 150 | 0.0231 | 8667 |
| C. 3 | Aluminum | 0.22 | 0.200 | 6.50 | — | 8 | 0.10 | 0.10 | 100 | 0.0154 | 200 |
| C. 4 | Aluminum | 0.22 | 0.200 | 6.50 | — | 9 | 0.10 | 0.10 | 450 | 0.0692 | 200 |
| C. 5 | Aluminum | 0.22 | 0.200 | 6.50 | — | 1 | 0.05 | 0.05 | 150 | 0.0231 | 400 |

In the table, "C." denotes "comparative". R represents Ratio of number-average particle diameters (B/A). X represents the metal element content per 1 g of the organosilicon polymer particle.

Example 1

The toner 1 was evaluated as follows. The evaluation results are shown in Table 3.

A modified LBP 712Ci (manufactured by Canon Inc.) was used as the evaluation unit. The process speed of the main body was modified to 250 mm/sec, and the necessary adjustments were made to allow image formation under these conditions. The toner was removed from a black cartridge, which was then filled with 150 g of the toner 1.

Evaluating Developing Performance

Durable Fogging Evaluation in High-Temperature, High-Humidity Environment

Fogging was evaluated after continuous use in a high-temperature, high-humidity environment (30° C./80% RH). Xerox 4200 paper (75 g/m$^2$; manufactured by Fuji Xerox Co., Ltd.) was used as the evaluation paper.

A 15000-sheet intermittent continuous use test was performed by outputting 2 sheets of a letter E image with a print percentage of 1% at 4-second intervals in a high-temperature, high-humidity environment.

A solid white image with a print percentage of 0% was then printed out using letter-size HP Brochure Paper 200 g, Glossy (basis weight 200 g/cm$^2$) as the transfer material in gloss paper mode (⅓ speed). Fogging density (%) was calculated from the difference between the whiteness of the transfer paper and the whiteness of the white part of the printout image as measured with a "Reflectometer Model TC-6DS" (manufactured by Tokyo Denshoku Co., Ltd.), and image fogging was evaluated.

An amber filter was used as the filter.

The smaller the number, the better the evaluation result. The evaluation standard is as follows. A rank of C or more is considered good.

Evaluation Standard

A: Less than 1.0%

B: At least 1.0% and less than 2.0%

C: At least 2.0% and less than 3.0%

D: At least 3.0%

Evaluation of Streak Images in High-Temperature, High-Humidity Environment

Streak images are roughly 0.5 mm vertical streaks that occur due to toner deterioration or contamination of the member by external additives, and this image defect is easily observed when a full-page halftone image is output.

Streak images were evaluated by first performing a 15000-sheet continuous use test in an environment similar to that of the fogging evaluation, and then outputting a full-page halftone image on Xerox 4200 paper (75 g/m$^2$; manufactured by Fuji Xerox Co., Ltd.), and observing the presence or absence of streaks. A rank of C or better is considered good.

Evaluation Standard

A: No streaks or toner clumps

B: No speckled streaks, but 1 to 3 small toner clumps

C: Some speckled streaks at edge, or 4 to 5 small toner clumps

D: Speckled streaks throughout, or 5 or more small toner clumps, or obvious toner clumps Evaluating Toner Carrying Member Contamination in High-Temperature, High-Humidity Environment Toner carrying member contamination is an image defect in which the toner becomes fixed to the toner carrying member and contaminates the toner carrying member, causing the concentration of a halftone image to rise during long-term use.

Toner carrying member contamination was evaluated in the same environment as the fogging evaluation by first outputting 100 sheets of a similar E letter image, and then outputting a full-page halftone image on Xerox 4200 paper (75 g/m$^2$; manufactured by Fuji Xerox Co., Ltd.) and measuring the density. A continuous use test was then performed up to 15000 sheets, a full-page halftone image was output in the same way, and the density was measured. Given the 100-sheet output as the initial density, the change in density after output of 15000 sheets was calculated.

Image density was measured using a "Macbeth Reflection Densitometer RD918" (manufactured by Gretag Macbeth) in accordance with the attached manual, by measuring relative density relative to a white part with an image density of 0.00, and taking the resulting relative density as the image density value. This was evaluated according to the following standard, and a rank of C or better is considered good.

Evaluation Standard

A: Density rise of less than 5.0% over initial halftone density

B: Density rise of at least 5.0% and less than 10.0% over initial halftone density C: Density rise of at least 10.0% and less than 15.0% over initial halftone density D: Density rise of at least 15.0% over initial halftone density.

Evaluating Transfer Efficiency in High-Temperature, High-Humidity Environment

As in the fogging evaluation above, transfer efficiency was confirmed at the end of the durability evaluation. A solid image with a toner laid-on level of 0.65 mg/cm$^2$ was developed on the drum, and then transferred to Xerox 4200 paper (Xerox Co., 75 g/m$^2$) to obtain an unfixed image. Transfer efficiency was then determined based on the change in mass between the amount of toner on the drum and the amount of toner on the transfer paper (transfer efficiency is 100% when all the toner on the drum is transferred to the transfer paper). A rank of C or better is considered good.

A: Transfer efficiency of at least 95%

B: Transfer efficiency of at least 90% and less than 95%

C: Transfer efficiency of at least 80% and less than 90%

D: Transfer efficiency of less than 80%

Evaluating Image Density in High-Temperature, High-Humidity Environment

As in the fogging evaluation above, image density was confirmed at the end of the durability evaluation.

A solid image was output on Xerox 4200 paper (Xerox Co., 75 g/m$^2$), and the image density was measured.

Image density was measured using a "Macbeth Reflection Densitometer RD918" (manufactured by Gretag Macbeth) in accordance with the attached manual, by measuring relative density relative to a white part with an image density of 0.00, and taking the resulting relative density as the image density value. This was evaluated according to the following standard, and a rank of C or better is considered good.

A: Image density of at least 1.40

B: Image density of at least 1.30 and less than 1.40

C: Image density of at least 1.20 and less than 1.30

D: Image density of less than 1.20

Examples 2 to 33, Comparative Examples 1 to 5

Toners 2 to 33 and comparative toners 1 to 5 were evaluated as in Example 1. The evaluation results are shown in Table 3.

TABLE 3

| | | High-temperature high-humidity environment | | | | | | | | |
|---|---|---|---|---|---|---|---|---|---|---|
| | | | | Contamination of member | | | | | | |
| Example No. | Toner No. | Fogging (%) | | Streak images | Contamination of toner carrying member (%) | | Transfer efficiency (%) | | Image density | |
| 1 | 1 | C | 2.6 | A | A | 4.1 | B | 93 | B | 1.35 |
| 2 | 2 | B | 1.5 | A | A | 4.2 | B | 94 | B | 1.36 |
| 3 | 3 | A | 0.6 | A | A | 4.1 | B | 93 | B | 1.35 |
| 4 | 4 | A | 0.5 | A | A | 2.7 | B | 94 | B | 1.34 |
| 5 | 5 | A | 0.4 | A | A | 2.7 | B | 92 | B | 1.36 |
| 6 | 6 | A | 0.1 | A | A | 1.4 | A | 96 | B | 1.37 |
| 7 | 7 | A | 0.3 | A | A | 1.4 | A | 98 | B | 1.38 |
| 8 | 8 | B | 1.3 | A | A | 1.4 | A | 99 | B | 1.36 |
| 9 | 9 | C | 2.2 | A | A | 4.1 | A | 99 | B | 1.35 |
| 10 | 10 | C | 2.5 | A | A | 4.1 | A | 98 | C | 1.28 |
| 11 | 11 | C | 2.6 | A | A | 4.3 | A | 98 | C | 1.26 |
| 12 | 12 | A | 0.4 | B | C | 10.8 | B | 91 | C | 1.26 |
| 13 | 13 | A | 0.2 | A | A | 1.4 | A | 97 | B | 1.33 |
| 14 | 14 | A | 0.3 | A | A | 1.4 | A | 98 | B | 1.36 |
| 15 | 15 | A | 0.3 | A | A | 1.4 | A | 99 | B | 1.30 |
| 16 | 16 | B | 1.2 | A | A | 2.7 | A | 98 | B | 1.32 |
| 17 | 17 | C | 2.3 | A | A | 2.9 | A | 98 | C | 1.27 |
| 18 | 18 | A | 0.7 | B | A | 2.8 | B | 92 | B | 1.34 |

TABLE 3-continued

| | | High-temperature high-humidity environment | | | | | | | | |
|---|---|---|---|---|---|---|---|---|---|---|
| | | | | Contamination of member | | | | | | |
| Example No. | Toner No. | Fogging (%) | | Streak images | Contamination of toner carrying member (%) | | Transfer efficiency (%) | | Image density | |
| 19 | 19 | A | 0.3 | A | A | 2.9 | A | 96 | B | 1.36 |
| 20 | 20 | A | 0.3 | A | A | 2.7 | A | 98 | B | 1.38 |
| 21 | 21 | A | 0.8 | B | B | 7.0 | A | 99 | B | 1.38 |
| 22 | 22 | A | 0.1 | A | A | 1.4 | A | 98 | A | 1.43 |
| 23 | 23 | A | 0.1 | A | A | 1.4 | A | 99 | A | 1.43 |
| 24 | 24 | A | 0.2 | A | A | 1.4 | A | 99 | A | 1.42 |
| 25 | 25 | B | 1.5 | A | A | 4.1 | C | 88 | B | 1.36 |
| 26 | 26 | C | 2.3 | A | B | 9.5 | B | 90 | B | 1.34 |
| 27 | 27 | A | 0.6 | A | B | 7.0 | A | 97 | B | 1.38 |
| 28 | 28 | A | 0.7 | A | B | 7.1 | A | 96 | B | 1.37 |
| 29 | 29 | B | 1.3 | A | B | 8.5 | B | 94 | B | 1.33 |
| 30 | 30 | A | 0.9 | A | A | 4.3 | B | 92 | B | 1.36 |
| 31 | 31 | B | 1.6 | A | B | 8.1 | B | 93 | B | 1.32 |
| 32 | 32 | B | 1.3 | A | A | 4.2 | B | 94 | B | 1.34 |
| 33 | 33 | B | 1.4 | A | A | 4.3 | B | 94 | B | 1.36 |
| C.E. 1 | C. 1 | D | 3.5 | C | B | 6.8 | B | 92 | C | 1.25 |
| C.E. 2 | C. 2 | D | 3.8 | A | B | 8.6 | B | 93 | C | 1.28 |
| C.E. 3 | C. 3 | A | 0.7 | D | D | 16.7 | C | 82 | C | 1.24 |
| C.E. 4 | C. 4 | D | 3.6 | A | A | 4.2 | B | 94 | C | 1.25 |
| C.E. 5 | C. 5 | C | 2.5 | C | D | 15.3 | D | 79 | C | 1.26 |

In the table, "C." denotes "comparative" and "C.E." denotes "comparative example".

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-246983, filed Dec. 28, 2018, which is hereby incorporated by reference herein in its entirety.

What is claimed is:

1. A toner comprising:

a toner particle containing a binder resin, and an organosilicon polymer particle having a hydroxyl group as an external additive, wherein the toner particle contains a polyvalent metal compound, the polyvalent metal compound is at least one selected from the group consisting of aluminum compounds, iron compounds and magnesium compounds, a content of a metal element derived from the polyvalent metal compound in the toner particle being from 0.080 to 20.000 μmol/g, a ratio of a number-average particle diameter of the organosilicon polymer particle to a number-average particle diameter of the toner particle is 0.0160 to 0.0650, and a content of the organosilicon polymer particle is at least 0.10 mass parts per 100.00 mass parts of the toner particle.

2. The toner according to claim 1, wherein a content of the metal element per 1 g of the organosilicon polymer particle is from 10 to 5000 μmol.

3. The toner according to claim 1, wherein a content of the organosilicon polymer particle is from 0.10 to 5.00 mass parts per 100.00 mass parts of the toner particle.

4. The toner according to claim 1, wherein a content of the metal element per 1 g of the organosilicon polymer particle is 20 to 400 μmol.

5. The toner according to claim 1, wherein the number-average particle diameter of the organosilicon polymer particle is 120 to 350 nm.

6. The toner according to claim 1, wherein a surface of the toner particle contains an amorphous vinyl resin having an acid value of 1.0 to 40.0 mg KOH/g.

7. The toner according to claim 1, wherein the organosilicon polymer particle has a structure of alternately bonded silicon atoms and oxygen atoms, the organosilicon polymer has a T3 unit structure represented by $R^aSiO_{3/2}$, where $R^a$ represents a $C_{1-6}$ alkyl group or phenyl group, and a ratio of an area of a peak derived from silicon having the T3 unit structure relative to a total area of peaks derived from all silicon elements contained in the organosilicon polymer particle is 0.90 to 1.00 in $^{29}$Si-NMR measurement of the organosilicon polymer particle.

8. The toner according to claim 1, wherein the polyvalent metal compound includes an aluminum compound.

9. The toner according to claim 1, wherein the ratio of the number-average particle diameter of the organosilicon polymer particle to the number-average particle diameter of the toner particle is 0.0200 to 0.0500.

* * * * *